US010569980B2

(12) United States Patent
Bhide et al.

(10) Patent No.: US 10,569,980 B2
(45) Date of Patent: Feb. 25, 2020

(54) MEDIA ALIGNMENT CALIBRATION

(71) Applicant: Hewlett-Packard Development Company, L.P., Houston, TX (US)

(72) Inventors: Saurabh Bhide, Vancouver, WA (US); Rafael Gonzalez, Vancouver, WA (US); Luke P Sosnowski, Camas, WA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 39 days.

(21) Appl. No.: 15/761,505

(22) PCT Filed: Dec. 8, 2015

(86) PCT No.: PCT/US2015/064517
§ 371 (c)(1),
(2) Date: Mar. 20, 2018

(87) PCT Pub. No.: WO2017/099731
PCT Pub. Date: Jun. 15, 2017

(65) Prior Publication Data
US 2018/0265316 A1 Sep. 20, 2018

(51) Int. Cl.
*B65H 7/08* (2006.01)
*B41J 13/00* (2006.01)
(Continued)

(52) U.S. Cl.
CPC ..... *B65H 7/08* (2013.01); *B41J 13/00* (2013.01); *B41J 13/0018* (2013.01); *B41J 29/38* (2013.01);
(Continued)

(58) Field of Classification Search
CPC .... B65H 7/08; B65H 9/002; B65H 2301/331; B65H 2511/242; B65H 2601/272; G03G 15/6567; G03G 2215/00561
(Continued)

(56) References Cited

U.S. PATENT DOCUMENTS 5,418,556 A * 5/1995 Andrews ..... B65H 23/0216 346/116
6,578,844 B2 * 6/2003 Acquaviva ..... B65H 7/08 271/228
(Continued)

FOREIGN PATENT DOCUMENTS

| | | |
|---|---|---|
| CN | 10137646 | 3/2009 |
| JP | 01214555 | 8/1989 |
| JP | 2002284399 | 10/2002 |

OTHER PUBLICATIONS

Newman, et al. "Measuring the Cosmic Equation of State with Galaxy Clusters in the DEEP2 Redshift Survey". Dept. of Astronomy, UC Berkeley, CA. Sep. 7, 2001 ~ 15 pages.

*Primary Examiner* — Michael C Mccullough
(74) *Attorney, Agent, or Firm* — HP Inc. Patent Department

(57) ABSTRACT

A media alignment calibration system determines a slope relating a trailing edge skew value to its paired leading edge skew value and an intercept representing native skew based on a linear regression of a predetermined number of a set of paired leading and trailing edge skew values for a media type stored in a buffer. Based on the slope and intercept, a media model for the media type is updated based on the linear regression to adjust a differential velocity of a pair of aligned media feed rollers in a media feed mechanism to correct both a future native skew and future paired leading and trailing edge skew values in the buffer to within a desired operational window.

15 Claims, 8 Drawing Sheets

(51) Int. Cl.
*B65H 9/00* (2006.01)
*B41J 29/38* (2006.01)
*B65H 7/06* (2006.01)

(52) U.S. Cl.
CPC ..... *B65H 7/06* (2013.01); *B65H 9/002* (2013.01); *B65H 2511/242* (2013.01); *B65H 2557/61* (2013.01)

(58) Field of Classification Search
USPC ..... 271/227
See application file for complete search history.

(56) References Cited

U.S. PATENT DOCUMENTS 7,006,785 B2 2/2006 Embry
7,222,848 B2 5/2007 Elliott et al.
7,593,684 B2 * 9/2009 De Jong ..... G03G 15/6567 271/227
7,717,533 B2 * 5/2010 De Jong ..... B65H 9/002 271/227
7,857,305 B2 12/2010 Sokolowski
8,061,709 B2 11/2011 Lewalski et al.
8,256,767 B2 * 9/2012 Williams ..... B65H 9/002 271/227
8,398,079 B2 * 3/2013 Ootsuka ..... B65H 7/08 271/234
8,764,007 B2 * 7/2014 Saito ..... B65H 7/08 270/58.32
8,814,160 B2 8/2014 Chen
2002/0177918 A1 * 11/2002 Pierel ..... B65H 7/06 700/124
2004/0094891 A1 5/2004 Trovinger et al.
2005/0280200 A1 12/2005 Sagi et al.
2007/0023994 A1 * 2/2007 Mandel ..... B65H 9/002 271/226
2011/0097125 A1 4/2011 Dejong et al.
2011/0215522 A1 * 9/2011 deJong ..... B65H 7/06 271/225
2012/0098879 A1 4/2012 Mandel et al.
2012/0133093 A1 * 5/2012 Saito ..... B65H 7/08 271/227
2012/0267847 A1 * 10/2012 Ootsuka ..... B65H 7/08 271/234
2018/0273325 A1 * 9/2018 Bhide ..... B65H 9/00
2018/0288256 A1 * 10/2018 Bhide ..... H04N 1/00779

* cited by examiner

MEDIA ALIGNMENT CALIBRATION

BACKGROUND

While the dream of a "paperless" office has been around for years, various forms of tangible cut sheet media continue to be used in significant quantities due to their versatile and permanent nature, such as paper, Mylar, plastic, photo paper, and the like. Some example cut sheet media devices include but are not limited to, printers, scanners, faxes, and copiers. However, hard copy media quality expectations continue to increase in this age of digital media. At the same time, prices for cut sheet media creation devices are being driven downward. This price decline is due to digital media's inherent ability to be re-used despite its transient nature, thus reducing some demand for cut sheet media output. As a result, both business and consumers are expecting that their cut sheet media devices be affordable and produce results with the same high quality as their digital media devices.

BRIEF DESCRIPTION OF THE DRAWINGS

The disclosure is better understood with reference to the following drawings. The elements of the drawings are not necessarily to scale relative to each other. Rather, emphasis has instead been placed upon clearly illustrating the claimed subject matter. Furthermore, like reference numerals designate corresponding similar parts through the several views.

DETAILED DESCRIPTION

Figure 1:
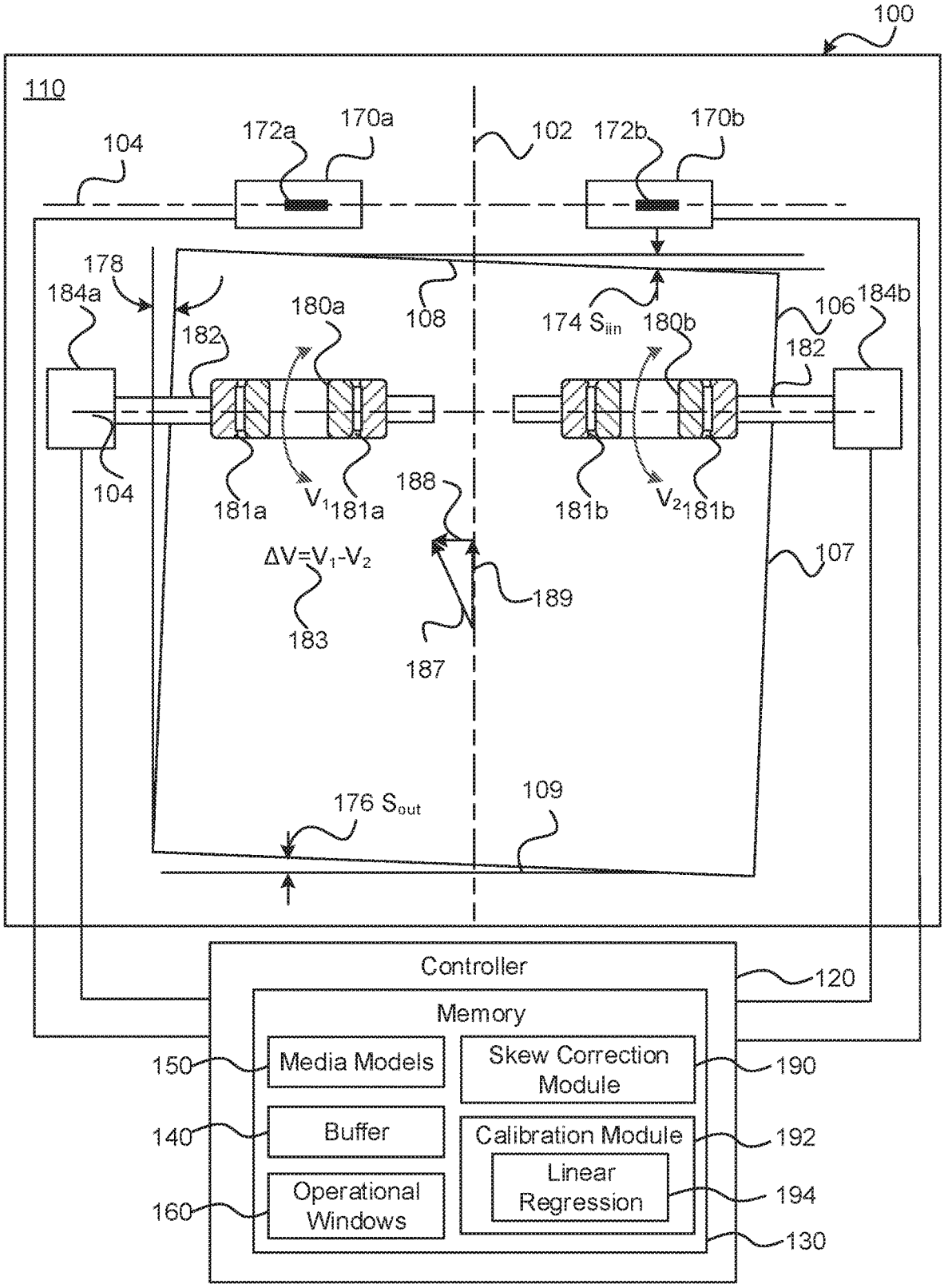
FIG. 1 is a simplified schematic diagram of an example media alignment system.

This disclosure describes a new auto-tune technique for correcting skew in media that is very flexible for varying media types and can be implemented with little component cost. 'Skew' is an oblique angle or a slant of the media relative to a centerline of the media or to a line representing a desired target for the media leading edge for further processing of the media. Media skew is generally desired to be corrected, reduced, or eliminated to achieve the highest quality results. The auto-tune skew correction technique discussed herein greatly improves a media handling device's versatility to correct such skew for multiple forms of media, media size, and media orientation by the use of media models that are used to correct skew for one or more media types. Media alignment systems are used in cut sheet media manipulation devices to ensure proper alignment of the media before it is processed such as with printers, scanners, copiers, coaters, and the like. With the auto-tune skew correction technique disclosed herein, the speed of media handling for the media manipulation devices may be greatly improved. There may also be an acoustical reduction in noise as any paper feed servo motors can be operated continuously without the constant starting and stopping of conventional nip and buckle type de-skewers typically found in conventional media manipulation devices.

In some examples, having a continuous feed skew adjustment allows for a significant increase in pages per minute of media processing. Further, if a media alignment system is found to be out of specification or the operating window for its de-skewing operation, a media characterization or an auto-tune calibration may be performed in order to restore the media alignment system back to acceptable operational levels for particular media that does not get properly de-skewed. For instance, a printer user interface may be presented to a user to linearize a relationship between induced skew and the differential velocity of separate media drive shafts as will be described.

For example, some model based active skew correction systems may be optimized for an 'ideal' media for a 'nominal' mechanism. This ideal model make such systems susceptible to various factors that may make a given media alignment mechanism non-conforming to the ideal model. In such instances, the process capability (Cp) and process capability index (Cpk) may be low. Cp is a measure of repeatability of a process, in this instance the ability of the media alignment system to repeatedly de-skew to a desired operational limit. Cpk is an index that measures how close a process is running to its desired operational limit relative to the natural variability of the process. Because businesses and consumers of cut sheet media devices expect high quality, to be commercially successful, both a high Cp and high Cpk is desired, but at a low cost. The auto-tune skew correction technique described within allows a media alignment system to be operated as closed looped. This close loop feature allows the technique to autonomously respond to various non-conformities, centering the performance on any desired operational limits and thereby achieving the desired high Cp and Cpk. The disclosed media alignment systems are versatile in handling a variety of media types and sizes with minimal impact on performance while reducing complexity. During development of a media alignment system, resource and time requirements may also be reduced. Further, the media alignment system cost may be reduced by allowing some component parts to have higher tolerance values while keeping the performance of the system optimal over the life of the mechanism, isolating it from the effects of wear and tear from use. These and other advantages will be described further in the following detailed discussion of the claimed subject matter.

FIG. 1 is a simplified schematic diagram of an example media alignment system 100. Media alignment system 100 may be used in such media manipulation devices such as fluid jet printers and copiers, toner based printers and copiers, scanners, sheet coaters, plotters, binders, collators, sorters, fax machines, signage printers, and other like devices which typically handle cut sheets of media. In this example, two rollers 180*a* and 180*b* are coupled to servo motor feeds 184*a* and 184*b*, respectively, and may be separated (or alternatively connected with a slip-shaft) as half-shafts. These half-shafts allow for the independent speed or velocity ($v_1$), ($v_2$) of rollers 180*a*, 180*b* by the respective servo motor feeds 184*a*, 184*b*. Theses dual independent servo motor feeds 184*a*, 184*b* and their respective rollers 180*a* and 180*b* may also be referred to as differential velocity drives. Each roller 180*a*, 180*b* may have one or more tires 181*a*, 181*b* (often times referred to also as COTS) to grip the media. The servo motor feeds 184*a*, 184*b* are coupled to a controller 120. The rollers 180*a* and 180*b* may be oriented along a first direction 104 that is typically substantially orthogonal to a second direction 102 in which a media 106 advances or retreats along a media guide mechanism 110. In some examples, there may be a slight angular offset between the first direction 104 and the second direction 102 and this is may contribute to a 'native skew' of the media alignment device 100.

The controller 120 may drive the servo motor feeds 180*a* and 180*b* in just a single forward direction or both forward and reverse directions independently depending on the implementation. The servo motor feeds 180*a* and 180*b* may also include encoders to determine the position of the respective servo motor. The differential velocity 'ΔV' 183 (defined as v1-v2) causes a media 106 to typically rotate clockwise or counterclockwise depending on the sign of Δv, while the average velocity of v1 and v2 determine the forward and/or backward speed in the direction of second direction 102. Accordingly, the media guide mechanism 110 includes a first roller 180*a* and a second roller 180*b* that are aligned in a first direction 104 that is substantially orthogonal to the second direction 102 for advancement of the media 106.

A memory 130 is coupled to the controller 120 and may contain a set of one or more media models 150. The actual design of the media models 150 are described further below but have been architected to account for a number of variables of the media type 107 and its interaction with a media alignment system 100.

For instance, the media 106 can be one of several media types 107. The media type 107 may include such factors as weight, material, thickness, size, orientation, stiffness, texture, color, transparency, opaqueness, to just name some examples. The media type 107 can also be influenced by such factors as humidity, media transit speed, variations in media alignment system construction, and other characterization parameters such as the number of tires 181 on the feed rollers 180*a*, 180*b* that are in contact with the media 106, and a media transit distance over which the differential velocity 183 is applied.

A pair of media sensors 170*a*, 170*b* have media edge detectors 172*a*, 172*b* respectively, such as switches, infrared, visible light, or ultraviolet LED diodes and semiconductor sensors or other mechanical or optical input devices, to detect a leading edge skew value 108 and a trailing edge skew value 109 of media 106. In some examples, the media sensors 170*a*, 170*b* may be REDI sensors. The media sensors 170*a*, 170*b* are coupled to the controller 120 and are substantially aligned in the first direction 104. In one example, each of the servo motor feed encoder positions may be read when each media sensor 170*a*, 170*b* is triggered. The difference in the same encoder position encoder values may then be used as the skew of the media 106. Alternatively in another example, when media 106 is skewed, there is a difference in time from when one of the media edge detectors 172*a*, 172*b* is triggered before the other media edge detector 172*a*, 172*b* is triggered. This time difference can be used with the media advancement speed or average velocity to derive the leading edge skew value 174 and the trailing edge skew value 176 as each respective leading edge 108 or trailing edge 109 passes beneath the pair of media edge detectors 172*a*, 172*b*.

In the example using the position encoder values, two snapshots of the servo motor feed encoder positions may be captured and stored in registers within the controller 120 as the leading 108/trailing 109 edge of the media 106 trips/untrips each of the pair of media sensor's 170*a*, 170*b* media edge detectors 172*a*, 172*b*. Media sensor 170*a* may be referred to as a front sensor and media sensor 170*b* may be referred to as a rear sensor. A de-skew encoder count snapshot for the front sensor may be labeled as $EC_{front}$ and a de-skew encoder count snapshot for the rear sensor may be labeled as $EC_{rear}$. The leading edge skew value 174 of the leading edge 108 of media 106, $S_{in}$, may then be determined by the difference in the encoder count snapshots. The direction of the leading edge skew value 174 is determined by the sign of $S_{in}$ where:

$$S_{in}=EC_{front}-EC_{rear}$$

The trailing edge skew value 176, $S_{out}$, is determined in the same manner as $S_{in}$ when the trailing edge 109 of media 106 passes beneath the media edge sensors 172*a*, 172*b*, where:

$$S_{out}=EC_{front}-EC_{rear}$$

$S_{out}$ may be used for verification of skew correction effectiveness and in deciding whether to perform a characterization of the media alignment system 100. Si, and $S_{out}$, may be paired and stored as arrays of pairs for successive sheets of media 106 that are feed in media alignment system 100. The paired arrays of $S_{in}$ and $S_{out}$ may be separated and maintained for a particular media size category or for a particular media type 107. For instance, in some example systems, there may be multiple media types 107 processed and a historical array of paired $S_{in}$ and $S_{out}$ values is maintained for each of the media types 107. The paired arrays may be stored in a buffer 140 in memory 130. The buffer 140 may be implemented as one or more circular buffers to store a predetermined number of last historical paired values.

Once both media edge sensors 172*a*, 172*b* have been triggered, a skew correction module 190 is executed by the controller 120 to adjust the velocities '$v_1$, $v_2$' of the first and second rollers 180*a*, 180*b* to create a differential velocity 183 '±Δv' based on a respective media model 150 for the media type 107 and the amount of leading edge skew 174 detected for the media 106. The differential velocity 183 '±Δv' is operated for a time period sufficient over a media travel distance 'd' 220 (FIG. 2) to reorient or de-skew the media 106 such that the trailing edge skew 176 is detected to be corrected within a desired operating window 160 for the media type 107 and the operating mode (speed, quality, resolution, etc.) of a particular media guide mechanism 110.

The skew correction module 190 may be very time sensitive in order to correct the skew within a desired distance 'd' 220 and thus may be executed as a high priority process in controller 120. When called, the skew correction module 190 modifies the servo motor feeds 184*a*, 184*b* relative speeds '$v_1$, $v_2$' by a differential velocity 183, '$\pm\Delta_v$'. The trigger of the two media edge sensors 172*a*, 172*b* may be continuously monitored using a servo motor interrupt level in the controller 120 during the timeframe that a page is expected to pass by the media edge sensors. As soon as the de-skew distance 'd' 220 is reached, the two servo motor speeds are then modified back to their original average speed 'v' of media 106 travel.

The controller 120 may include a tangible, non-transitory computer readable medium (CRM) 804 (FIG. 8) such as memory 130. Memory 130 may contain a set of one or more media models 150 and a set of one or more various desired operational windows 160 for the various media types and operating modes of the media guide mechanism 110. The memory 130 may also contain one or more software or firmware modules of computer executable code or instructions that when executed by the controller 120 (or one or more processors within the controller 120) cause the controller 120 to implement and execute the skew correction module 190. In addition to skew correction module 190, a calibration module 192 may be used to adjust media models 150 using a linear regression module 194 to keep the media guide mechanism 110 within the various desired operational windows 160. Controller 120 may include one or more processors integrated into a single devices or distributed across devices. The calibration module 192 in the memory 130 is executable by the controller 120 to update a media model 150 of the media type 107 based on a linear regression of the set of paired values in the buffer 140 to adjust a differential velocity 183 of the first and second rollers to increasingly align a leading edge of a next media within a desired operational window. The calibration module 192 may be called to be operable after a trailing edge skew value 176 is outside of the desired operational window or after a predetermined number of the media type 107 transit the media guide mechanism 110.

This technique for skew correction uses the two pairs of rollers 180*a*, 180*b* to cause the media to both advance by a transit force 189 in the second direction 102 based on an average velocity 'v' of the rollers 180*a*, 180*b*. By introducing a differential velocity between the two rollers 180*a*, 180*b* a shear force 188 orthogonal to the media advancement force causes the media 106 to rotate and de-skew during the same time that media 106 is advanced. The combination of the two forces 188, 189 creates a net shear force vector 187 that is applied to the media 106 for a set period of time that is calculated based on the media model and media speed to substantially de-skew the media 106 so that when the trailing edge 109 of the media 106 reaches the dual media edge sensors 172*a*, 172*b*, the media 106 is corrected or de-skewed to within an acceptable operational window 160.

Figure 2:
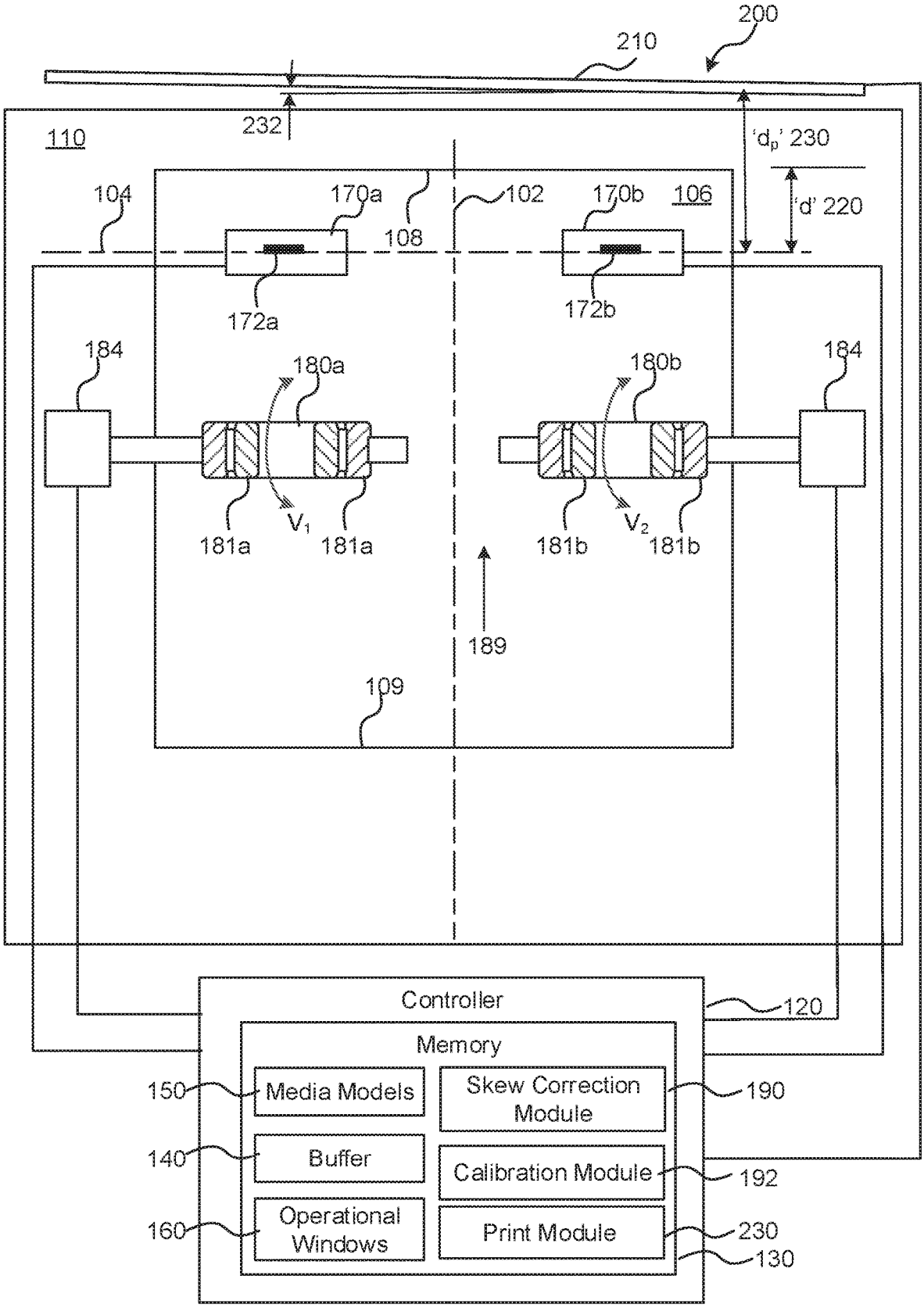
FIG. 2 is an example media guide mechanism that includes a printhead.

FIG. 2 is an example printer media alignment system 200 that includes a target objective, a print bar printhead 210 aligned and extending substantially along the first dimension 104 and a print module 230 to allow for printing on the media 106. In other examples, rather than a print bar, the printhead 210 may scan across a line extending substantially along the first dimension. In other examples, other target objectives such as a scan bar may be used in place of print bar printhead 210, as for a scanner or fax device. The printhead 210 while substantially extending along the first dimension 104 may have an angular offset 232 from a line extending between the pair of media edge sensors 172*a*, 172*b*, and thus leading edge 108 of the shown de-skewed media 106. The media 106 leading edge 108 should be aligned with the printhead 210 for highest quality and thus the media models 150 may adjust for this angular offset 232. This angular offset 232 may also be incorporated into the 'native skew' of the media alignment mechanism 110. The media 106 is shown as having been de-skewed after the leading edge has traveled a distance 'd' 220 from the pair of media edge detectors 172*a*, 172*b*. The distance 'd' 220 may be less than the distance '$d_p$' 230 to the printhead 210 to ensure media alignment with respect to the target printhead before printing. However, in some examples, such as with a blank top margin of the media, the distance 'd' 220 could be larger than the distance '$d_p$' 230 to distribute the de-skew shear force 188 over a longer distance to put less stress on the media 106.

The distance 'd' may be calculated based on one or more factors, such as media speed, rotation per encoder sample, the time available to perform the media alignment, the amount of skew that needs to be corrected, and the media type and its ability to handle the shear forces involved in the de-skew process. Further, based on a particular hardware architecture and implementation, there may be physical limits on how much skew can be corrected based on lengths of specific media 106. Any attempt to correct a skew larger than such a limit may require multiple passes of the media through the de-skew process or alerting a user to realign the media such as is done with paper jams. For instance, the media may be placed in a media tray incorrectly such that the media tray pick mechanism is causing multiple sheets of media to be skewed more than can be corrected. Having the user check the media tray and position the media correctly may limit the amount of possible skew to within what may be corrected.

Figure 3:
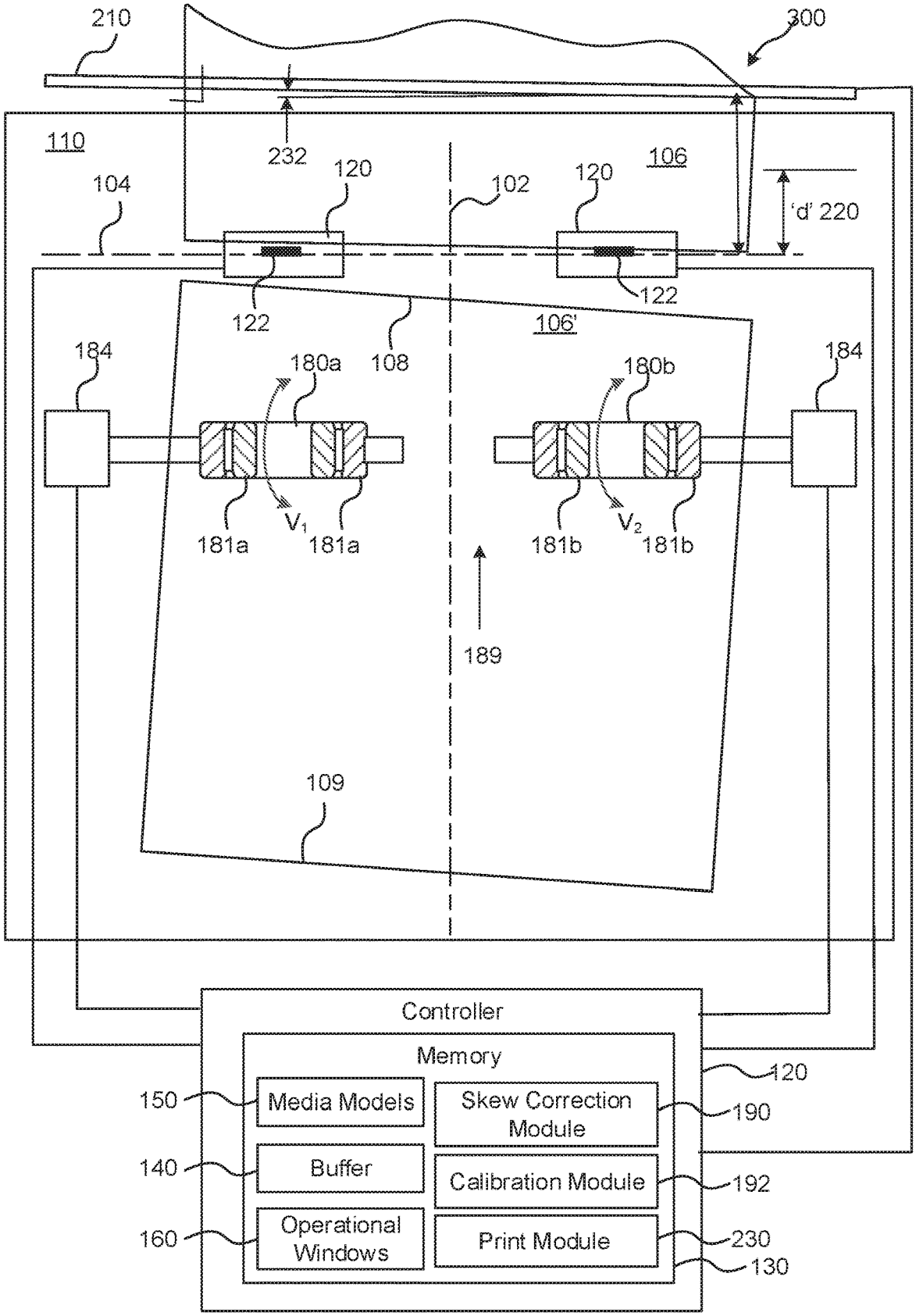
FIG. 3 is a further example of the mechanism of FIG. 2.

FIG. 3 is a further example of the printer media guide mechanism of FIG. 2 illustrating the advancement of media 106 such that its trailing edge 109 is detectable by the pair of media edge sensors 122*a*, 122*b*. In this example, the media 106 is shown slightly skewed with respect to the axis of first dimension 104 to highlight that the angular offset 232 of the printhead 210 has been corrected. The pair of media edge sensors 122*a*, 122*b* can be used to measure the skew of the trailing edge 109 to confirm proper alignment with the printhead 210 and/or used to keep statistics of printer performance for determining if a characterization, calibration, or service maintenance should be performed. A second media 106' is shown as skewed and being advanced to the media edge sensors 122 by rollers 180*a*, 180*b* to begin the de-skew technique for a second media 106'.

In some examples, there may be more than one set of differential drives. For instance, there may be separate media paths each with a set of differential drives. In other examples, the multiple differential drives may be in series in a media path to allow for skew correction over a longer distance and/or to lessen the amount of shear force on the media at each set of the differential drives to reduce the risk of media tear or deformation. In another example, such as with an all-in-one device, there may be a set of differential drives for a printer function and another set of differential drives for a scanner function. In some instances, two or more sets of differential drives may be mechanically coupled but used for different purposes.

Figure 4:
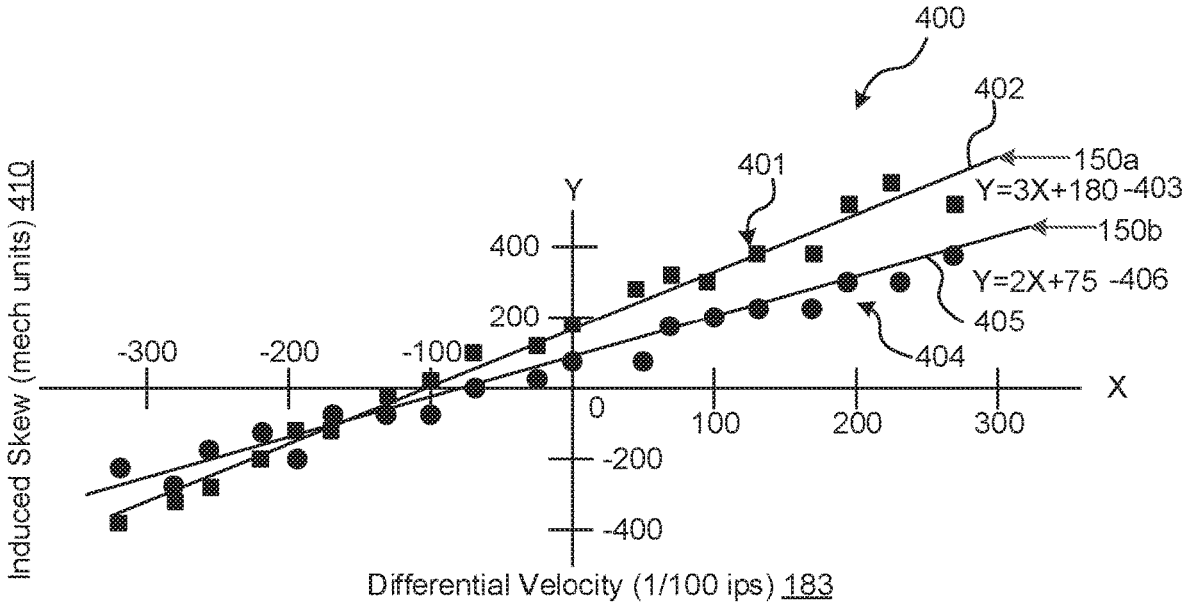
FIG. 4 is a chart illustrating example media responses of differential velocity versus induced skew data.

FIG. 4 is a chart 400 illustrating media responses of differential velocity 183 '±Δv' versus the induced skew 410 for a couple example media types 107. Since the media alignment system 100 uses two sets of rollers 180*a*, 180*b* to affect media alignment, the media 106 does not undergo a pure rotation but rather is subjected to a shear force 188 (FIG. 1) in the plane of the media. This shear force is difficult to model mathematically for all media types and media marking conditions. Accordingly, it is the insight of the inventors that by choosing to characterize the response of media 106 to various differential velocities 183 by means of empirical testing this media response characterization allows for the incorporation of multiple factors that affect skew. For instance, the "induced skew" 410, the difference between the leading edge skew 174 and the trailing edge skew 176 for a single media 106, can be measured and plotted against a set of applied "differential velocity" 183 for various media types 107.

In FIG. 4, the X axis represents the applied differential velocity 183 in units of 1/100 inches per sec (ips). Positive values indicate a first roller 180*a* having a greater speed than a second roller 180*b*, and negative values indicate the first roller 180*a* having a slower speed than the second roller 180*b*. The Y axis represents the media response in terms of measured induced skew 410 in units of mechanical units (mech units of the encoder) wherein the positive values measure skew in one rotation and negative values measure skew in an opposite rotation.

The square markers 401 represent a first example media response characterization population of a first media model 150*a* to determine the induced skew 410 with respect to various differential velocities 183. The test can be performed with a single sheet of media 106 run several times through the media alignment system 100, 200 with varying differential velocities 183 for each pass, or it can be performed running several different sheets of the media 106, say from a media tray, each at a different differential velocity 183 setting and the induced skew 410 derived from the leading 108 and trailing edges 107 skews measurements. The circle markers 404 represent a second example media response characterization population of a second media model 150*b* and is created similarly as for the first media model 150*a*. Each media model's characterization population is then linearized using linear regression to create a first response curve 402 for the first media model 150*a* and a second response curve 405 for the second medial model 150*b*. Each of the response curves 402, 405 has a slope 'm' and an intercept 'b' for the respective media model 150*a*, 150*b*. For instance, first media model 150*a* has a response curve 402 that is represented by a first equation 403, Y=3X+180, where "3" is the slope 'm' and "180" is the intercept 'b'. Second media model 150*b* has a response curve 405 that is represented by a second equation 406, Y=2X+75, where "2" is the slope 'm' and "75" is the intercept 'b'.

Let $S_{in}$ be the initial leading edge skew value 174 of a media 106. Correcting for $S_{in}$ is simply inducing a skew of $-1*S_{in}$. To apply a $+\Delta v$ change to the first roller 180*a* and a $-\Delta v$ change to the second roller 180*b* for a specific distance 'd' 220 of media travel, the 'differential velocity' 183 (in encoder mech. units) to apply for a given media model's slope m and intercept b is:

$$\Delta_v = \left(\frac{-1*S_{in}-b}{m}\right)\Big/2$$

Empirical testing has found, however, that a particular media model's 'm' and 'b' may be sensitive to several system aspects. For instance, the specific hardware configuration such as the number and placement of the tires 181*a*, 181*b* on the rollers 180*a*, 180*b* performing the skew correction, the media type 107, the size of the media, the media alignment mechanism 110 mode's average speed 'v', and the media travel distance 'd' 220 over which the 'differential velocities' 183 are applied. Empirical testing has shown that the constant 'b' is very sensitive to mechanical variations in hardware, unlike the constant 'm' which is not very sensitive. A lookup table for the constants 'b' and 'm' for different media models 150 or in some examples, just indexed by media lengths, may be stored in non-volatile memory (NVM) of the controller 120 in the media models 150 portion of memory.

The media model 150 for particular media 106 may be sensitive to the number of tires 181*a*, 181*b* on each half-shaft of the medial alignment system 100, 200 as well as their placement relative to the center of the media 106. Also, even when the hardware configuration of the media alignment system 100, 200 is constant, the media model 150 may be different for different media types 107 and therefore, a hardware configuration that has minimal changes between different media types 107 may allow for having a particular media model 150 represent multiple media types 107. For instance, in one example, having three equally spaced tires per roller on the half-shafts may reduce the variation of constants 'm' and 'b' for multiple media types 107 allowing for a single media model 150, optimized around an expected high use media 106 for the particular media alignment system 100, 200. That is, allowing the high use media model 150 to correct for various media types 107 of the same size may yield results that satisfy overall system operational requirements. However, in some instances where excellent image quality is desired, using a specific media model 150 for a specific media type 107 may yield the best results.

The media size determines how many of the roller tires 181*a*, 181*b* are in contact with the media 106 as well as how many rollers 180*a*, 180*b* are in contact with the media 106 during the "differential velocity" phase of skew correction. Media orientation (i.e. portrait vs landscape) may essentially change the media size (width and length) presented to the skew correction hardware. Width is defined to be across the media in the first direction 104 and length is defined to be along the media flow in the second direction 102. Accordingly, the media models 150 may be indexed by size and orientations, such as A-landscape, A-portrait, 4×6"-portrait, 4×6"-landscape, and 11×17"-portrait, as just some examples, and the respective corresponding constants 'm' and 'b' may be stored in a firmware lookup table in memory 130 accessible by the controller 120. To pick a particular media model 150 during operation, various combinations of paper-path media edge sensors, length sensors, paper information from print drivers, etc. allow for determination and selection of the correct media model 150 to get the correct correction constants 'm' and 'b'.

For instance, when a media tray is reloaded in the media alignment system 100, 200, one can assume that the media length equals the reading of the media tray length sensor and verify that it matches the specified media for the job via an operating system driver, such as a print driver. Alternatively, or in conjunction, the media length can be measured using paper-path edge sensors for the first sheet. Based off of the media type 107 and the determined or measured media length, the appropriate constants 'm' and 'b' in the media models 150 may be retrieved from lookup tables in memory 120. Successive pages from the same tray may then use the measured length of the media until the tray is opened.

It may be desirable to keep the media travel distance 'd' 220 constant for which the overall differential velocity 183 '$\pm\Delta_v$' is active to reduce firmware complexity. The media velocity is defined by the average speed of the first and second rollers 180*a*, 180*b* during skew correction. The distance 'd' 220 along with the average velocity 'v' define how long the differential velocity 183 is applied. The longer this time period, the more 'rotation' the media 106 undergoes. Accordingly, the media model 150 for determining differential velocity 183 may be changed to include or incorporate a linear relationship between a prior media model without speed correction and the average speed "v" such that a first alternative media model 150 is:

$$\Delta_v = \left(\left(\frac{-1 * S_{in} - b}{m}\right) \Big/ 2\right) * \left(\frac{v}{v_{cal}}\right)$$

Where $v_{cal}$ is the average speed of the first and second rollers 180*a*, 180*b* used during the 'differential velocities' phase of skew correction, while generating the media model 150.

The media travel distance 'd' 220 is the distance of media travel over which the differential velocity 183 is maintained and affects how much 'rotation' the media 106 undergoes. The longer the distance, the more 'rotation' for a given differential velocity 183. While a fixed distance 'd' 220 may be desired, it is anticipated that the actual distance available in a particular hardware configuration of the media alignment system 100, 200 may change due to design changes or even firmware interactions with other threads of programs operating on the controller 120. The media model 150 equation may be adjusted to take into account or include that possibility such that a second alternative media model 150 is:

$$\Delta_v = \left(\left(\frac{-1 * S_{in}\left(\frac{d_{cal}}{d}\right) - b}{m}\right) \Big/ 2\right) * \left(\frac{v}{v_{cal}}\right)$$

Where $d_{cal}$ is an adjustment distance and distance 'd' 220 is the actual distance the skew correction occurs for the particular media alignment system 100, 200.

Another possible adjustment to the media model can be with respect to the pair of media sensor's 120*a*, 120*b* "squareness". For instance, due to mechanical variation, each media alignment system 100, 200 may have a unique 'native skew' or angular offset 232 (measured with respect to the plane of the media leading edge 108), referred to herein as "zero offset" or $S_{zero}$. For instance, $S_{zero}$ may be measured between a printhead, scan bar, or other target objective for the media 106 and a line (first dimension 104) created by the two media edge detectors 122*a*, 122*b* as shown in FIG. 2. The new $S_{zero}$ adjusted media model is then:

$$\Delta_v = \left(\left(\frac{-1 * S'_{in} * \left(\frac{d_{cal}}{d}\right) - b}{m}\right) \Big/ 2\right) * \left(\frac{v}{v_{cal}}\right)$$

Where $S'_{in}=S_{in}+S_{zero}$. The $S_{zero}$ 'native skew' value is a characteristic of a particular media alignment system 100, 200 and may be stored in non-volatile memory (NVM) in controller 120 after it is characterized or otherwise measured. The $S_{in}$ and $S_{out}$ captured during the "snapshot" of encoder positions are then compensated for by this $S_{zero}$ value to generate $S'_{in}$ and $S'_{out}$, which are used in the media model equations.

As noted, in some examples a predetermined amount of history of $S'_{in}$ and $S'_{out}$ pairs may be stored in a buffer 140 in memory 130. In some examples, the buffer 140 may be implemented as a circular buffer. For instance, a running sample of the last 30 $S'_{in}$ and $S'_{out}$ pairs may be statistically evaluated to determine if a characterization, or maintenance service needs to be performed. Alternatively, is a particular $S'_{out}$ value is outside of a desired operational window 160, the calibration module 192 may be executed by controller 120.

In some instances, a large $S'_{in}$ may cause a large '$\Delta_v$' which has the potential to damage the media 106 by way of inducing crinkles into it or even tearing the media 106 due to in-plane shear. In one example, the media alignment system 100, 200 may perform multiple passes of the media 106 through the system before further processing it in order to correct for a large $S'_{in}$. Thus, the skew correction module 190 may be executed by the controller 120 multiple times for the media 106 to limit the amount of skew correction per pass to prevent damage to the media 106. The instructions in the skew correction module 190 may thus determine the media type 107 and limit the differential velocity 183 in a single pass to allow for only a limited edge skew correction value. Then by using multiple passes of the media 106 through the pair of aligned media sensors 120*a*, 120*b* to correct over multiple passes a leading edge skew greater than the limited edge skew correction value.

Figure 5:
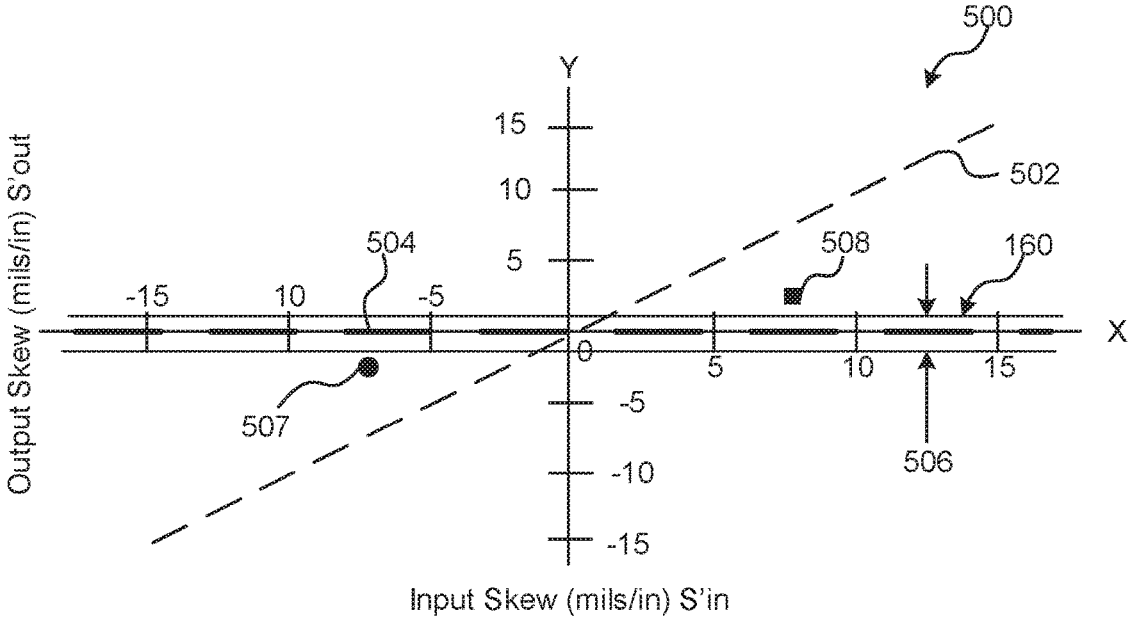
FIG. 5 is a result chart with example input skew "$S'_{in}$" on the X axis and example resultant output skew "$S'_{out}$" on the Y axis.

FIG. 5 is a result chart 500 with the example media response to input skew $S'_{in}$ in mils/in units on the X axis and the output skew $S'_{out}$ in mils/in units on the Y axis. First dashed line 502 has an 'm' value of 1 and a 'b' value of 0 and represents what would be expected if there were no skew correction or adjustment made. That is, the output skew would match the input skew. Second dashed line 504 is on the X axis and has an 'm' value of 0 and a 'b' value of '0' and represents a perfect correction or reduction of skew. However, in actual products, complete correction of skew may not always be possible and most values may lie between a desired operational window 160 which limits the output skew to a range within the skew tolerance width 506 of the operational window 160. In one example, the operational window 160 skew tolerance width 506 may be +/−1.5 mils per inch. Also, the operational window may include a trigger value for flagging when to service the media alignment system 100. For example, if more than 50% of the media pages fall outside of the skew tolerance width of +/−1.5 mils, then a service message, media characterization, or calibration module 192 execution may be requested. In another example, the calibration module 192 execution may be requested when any $S'_{out}$ value is outside the desired operational window 160. Depending on a media alignment systems 100, 200 implementation, there may be one or more operational windows 160 in memory 120. The different operational windows 160 would be chosen based on the media type 107 and the expected results desired given a various operating modes of the media alignment system 100, 200, such as a high, medium, or draft selection of print modes. Some media types 107, such as clear Mylar sheets for overhead slides, may want a relaxed operating window 160 to limit the amount of shear force on the media which may cause visual distortions. Media types for photographs may want a narrowed operating window 160 to ensure accurate alignment of the printed photos for later cutting of the photos from the media.

Occasionally, there may be data pairs such as first data pair 507 and second data pair 508 which did not correct the output skew such that they fall outside the operational window 160. Based off the number of times such events occur or based off of statistics of past history results, action may be taken such as notifying the user of the media alignment system that service is required, scheduling a service call, performing a maintenance characterization or calibration, flagging an error, providing a warning message, or adjusting the various media models with calibration module 192 accordingly if a consistent error is being made. For instance, calibration module 192 may be performed for a printer by having a user load a paper tray with a set of sheets of the media types 107 that are having skew correction issues. The printer can run the set of sheets of media 106 through the media alignment system 100, 200 to create a set of induced skews 410 versus various different differential velocities 183 for each of the set of sheets, which may be of one or more media types 107. A media model 150 may then be updated based on the empirical results to create a new linear 'b' and 'm' model for the printer for each media type 107.

Figure 6:
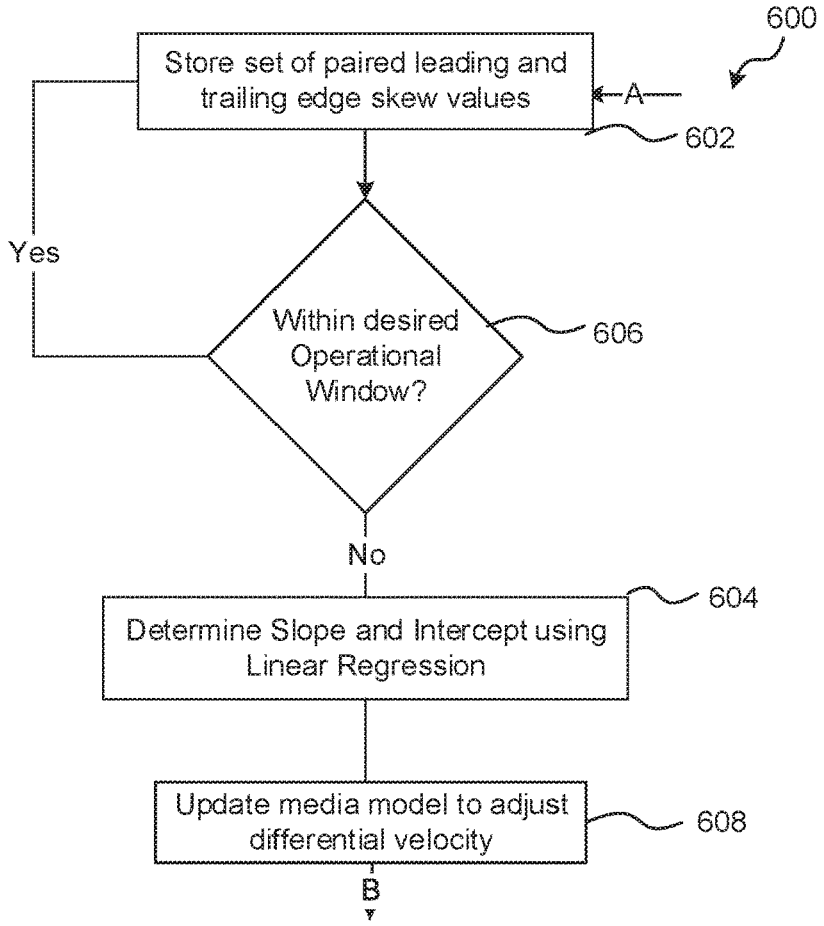
FIG. 6 is a method for an example calibration module to align a media by updating a media model in a media alignment system.

FIG. 6 is a method 600 for an example calibration module 192 to aligning a media 106 by updating a media model 150 in a media alignment system 100, 200. In block 602, a set of paired leading 174 and trailing 176 edge skew values for a type 107 of the media 106 are stored in a buffer 140. In decision block 606, the trailing edge skew values are checked to see if the skew correction module 190 is operating within a desired operational window 160 for the media type 107. If operating within the desired operation window 160, then no update of a respective media model 150 for the media type 107 is performed and the method returns to block 602. If it is determined that the skew correction module 190 is not performing within a desired operational window 160 for the media type 107, then, In block 604, a slope 'p1' relating a trailing edge skew value 176 to its paired leading edge skew value 174 and an intercept 'p2' representing a native skew based on a linear regression of a predetermined number of the set of paired leading 174 and trailing 176 edge skew values are determined. Then in block 608 the respective media model 150 for the media type 107 is updated to adjust a differential velocity 183 of a pair of aligned media feed rollers 180*a*, 180*b*, in a media feed mechanism 110 to correct both the native skew and future paired leading 174 and trailing 176 edge skew values in the buffer 140 to within a desired operational window 160.

Figure 7:
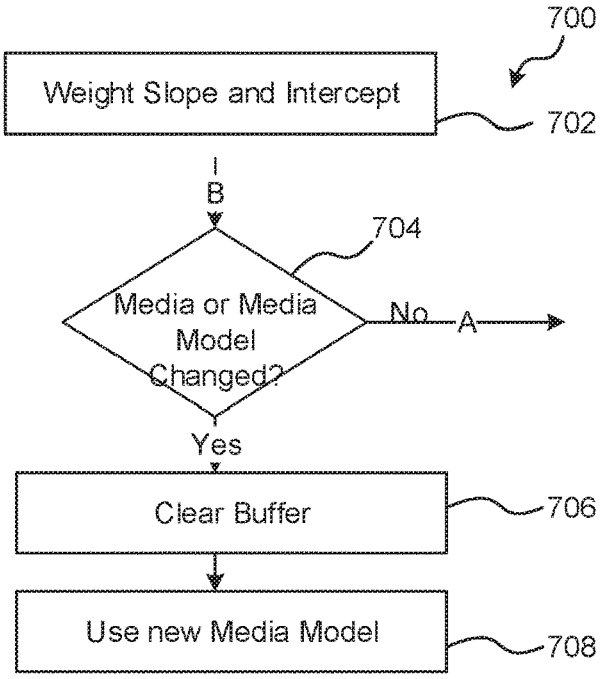
FIG. 7 is a set of additional method blocks that may be incorporated in to the method of FIG. 6 for the example calibration module.

FIG. 7 is an example set of additional blocks 700 that may be incorporated into the method 600 of FIG. 6 of calibration module 192. For instance, in block 702 the slope 'p1' and the intercept 'p2' may each be weighted with a weight factor to before updating the media model 150. By weighting the slope 'p1' and/or the intercept 'p2', the risk that the latest data may be erroneous is managed to prevent over-correction and allow for a more gradual convergence to a steady state media model 150. If the weight is too high and the frequency of updating the media model 150 is also too high, the updating of the media model 150 may be unstable. Generally, the higher the frequency of updating the media model 150, there are less data pairs for the linear regression for the determination of the slope 'p1' and the intercept 'p2' and thus they may not be as accurate as when the frequency of updating Is less and more data points are available to more accurately predict the slope 'p1' and intercept 'p2'. A slower frequency of updating the media model 150 allows for more stability but there may be a longer time period for a steady state media model 150 to converge to an accurate solution. Both too long a period for convergence and to fast a frequency of updating the media model 150 may cause user dissatisfaction. The appropriate selection is based on empirical testing and expected user use of the media alignment system 100,200.

Decision block 704 may continue from block 608 and a check made of the media alignment system 100, 200 to see if the media 106 or media model 150 has changed. If not, then the skew calibration module 192 may continue at block 602. If yes, then the buffer 140 may be cleared and in block 708 new data points of the paired leading 174 and trailing 176 edge skews may be stored in the buffer 140 using a new media model 150.

In order for the calibration module 192 to perform well, it should not respond to bad data and thus some noise rejection techniques may be implemented to identify various forms of noise from the detected leading 174 and trailing 176 edge skew values. For instance, the stochastic nature of the system due to the varying media properties, the wear of the mechanisms, dust and other contaminants, temperature, and humidity, to name just a few, may, while rare, sometimes create outliers such as first data pair 507 and second data pair 508 in FIG. 5. Calibration model 192 may include instructions to have the linear regression module 194 ignore paired leading 174 and trailing 176 edge skew values that are outside of a predetermined statistical range of the set of paired leading 174 and trailing 176 edge skew values in the buffer 140. For example, the statistical range can based off of a multiple of the standard deviation of the residual error population, such as throwing out data points that have a residual error outside of about $\pm 3\sigma$ limits of the residual error population.

Another noise rejection technique is to use the $R^2$ coefficient of determination statistic. When $R^2$ is low, the media alignment system 100, 200 is behaving as expected since the skew correction activity breaks the correlated relationship between the leading 174 and trailing 176 edge skew values. Alternatively, if $R^2$ is low, the media alignment system 100, 200 may be acting incorrectly causing the correlated relationship between the leading 174 and the trailing 176 edge skew values to be broken as well. In either case, the system operating correctly or the system not behaving as expected, the adjustment of the constants in media model 150 should not be adjusted.

Another statistical technique may be used separately or in addition to $R^2$ to discern if the media alignment system 100, 200 is operating correctly or not. This additional technique may be used to monitor and reject noise in the population data by examining the range, standard deviation, or scatter aspect ratio of both the leading 174 and trailing 176 data populations. If the respective range, standard deviation, or scatter aspect ratio is larger in the leading edge skew value 174 population than in the trailing edge skew value 176 population, then there is a high confidence that the system is operating correctly.

Figure 8:
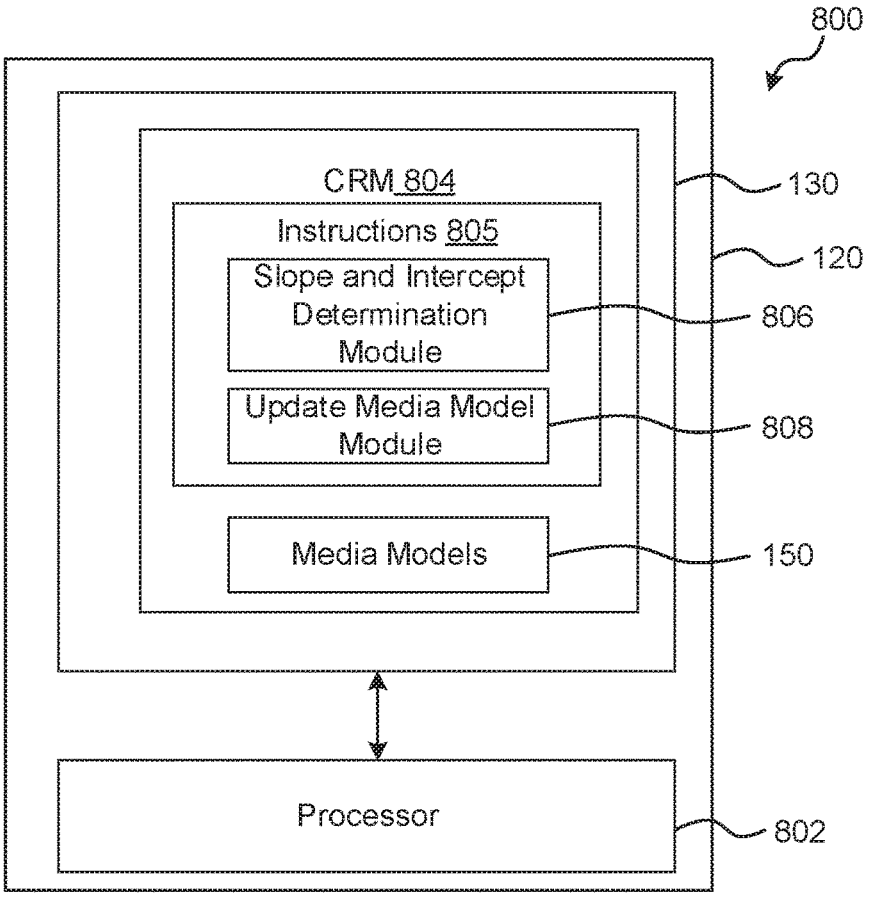
FIG. 8 is an example implementation of a controller to update a media model which may include a computer readable medium (CRM)

FIG. 8 is an implantation 800 of an example controller 120 which may include tangible and non-transitory computer readable medium (CRM) 804 coupled to a processor 802. CRM 804 may be integrated into the same device as controller 120 or it may be separate but accessibly coupled to controller 120. In one example, the instructions may be part of an installation package that when installed may be executed by the controller 120 to implement the media alignment system 100. In this example, the CRM 804 may be a portable medium such as a CD, DVD, or flash drive or a memory maintained by a server from which the installation package may be downloaded and installed.

In another example, the instructions may be part of an application or applications already installed. In this example, CRM 804 may include integrated memory such as hard drives, solid state drives, flash drives, dynamic or static random access memory, programmable read only memory, and the like. Accordingly, the computer readable medium 804 may include processor cache of one or more levels, dynamic random access memory (DRAM), non-volatile memory such as flash, EEPROM, PROM, and the like as well as magnetic memory, optical memory, ionic memory, phase change memory, and other equivalent types of long term storage including battery backed static random access memory (SRAM). CRM 804 may include the memory 130.

The processor 802 may include one or more cores of general purpose central processing units (CPU) or one or more cores of special purpose algorithmic processing units, such as digital signal processors, I/O controllers, video controllers, ladder controllers, and the like. The processor 802 is coupled to the CRM 804 and is able to read and write instructions 805, such as instruction to implement a slope 'p1' and intercept 'p2' determination module 806, an update media model module 808, skew correction module 190 (FIG. 1), and data such as media models 150, operational windows 160 (FIG. 1), and the various data pairs derived from the pair of media edge sensors 172*a*, 172*b* in buffer 140 (FIG. 1).

The instructions 805 for the slope 'p1' and intercept 'p2' determination module 806 may include instructions to determine a slope 'p1' relating a trailing edge skew value 176 to its paired leading edge skew value 174 and an intercept 'p2' representing a current 'native skew' based on a linear regression of a predetermined number of a set of paired leading and trailing edge skew values for the media type 107 stored in a buffer 140 readable by the processor 102. The update media model module 808 may include instructions such that based on the slope 'p1' and intercept 'p2', the instructions update a media model 150 for the media type 107 based on the linear regression module 194 to adjust a differential velocity 183 of a pair of aligned media feed rollers 180*a*, 180*b*, in a media feed mechanism 110 to correct both the future 'native skew' and future paired leading 174 and trailing 176 edge skew values in the buffer 140 within a desired operational window 160.

Figure 9:
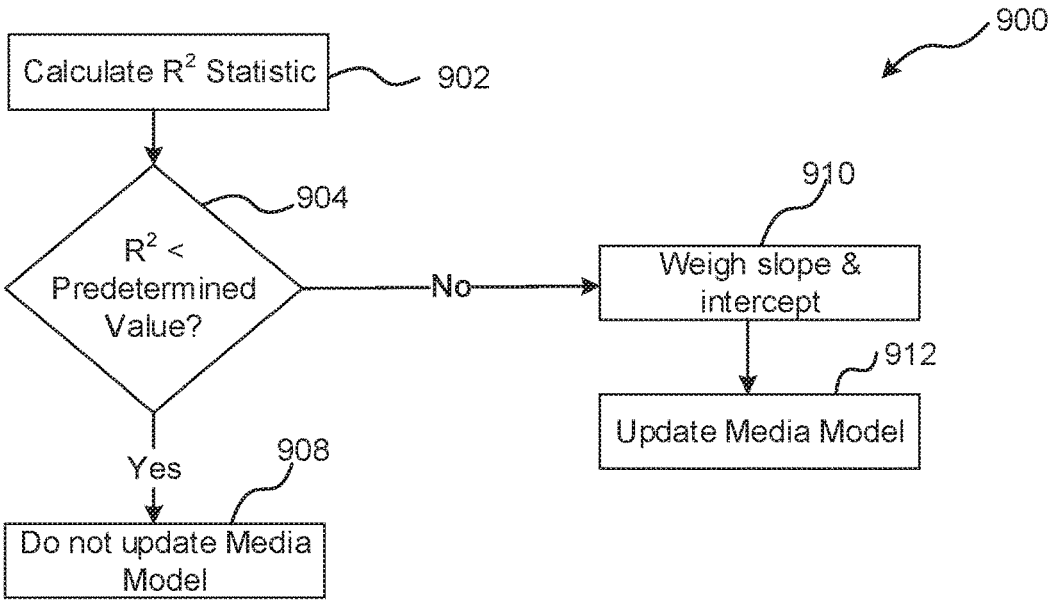
FIG. 9 is an example set of additional instructions for the CRM of FIG. 8 that may be used to improve the updating of the media model.

FIG. 9 is a set of additional example instructions 900 for CRM 804 that may be used to improve the updating of the media model 150. In block 902 the instructions may calculate the $R^2$ statistic during the linear regression module 194 execution of the set of paired leading 174 and trailing 176 edge skew values in the buffer 140. In decision block 904 a determination is made whether the $R^2$ statistic is below a predetermined value. If it is, then in block 908 the media model 150 is not updated. If the $R^2$ statistic is greater than the predetermined value then either or both of the slope 'p1' and the intercept 'p2' of the data population may be weighted before updating the media model 150. By using weights on the slope 'p1' and the intercept 'p2', the media model 150 may be iteratively updated over successive operations of the calibration module 192. Further, the additional instructions 900 may include instructions to ignore paired leading 174 and trailing 176 edge skew value having a residual error of the paired leading 174 and trailing 176 edge skews that are outside of a predetermined range of a residual error of a population of the set of paired leading 174 and trailing 176 edge skew values in the buffer 140.

Figure 10:
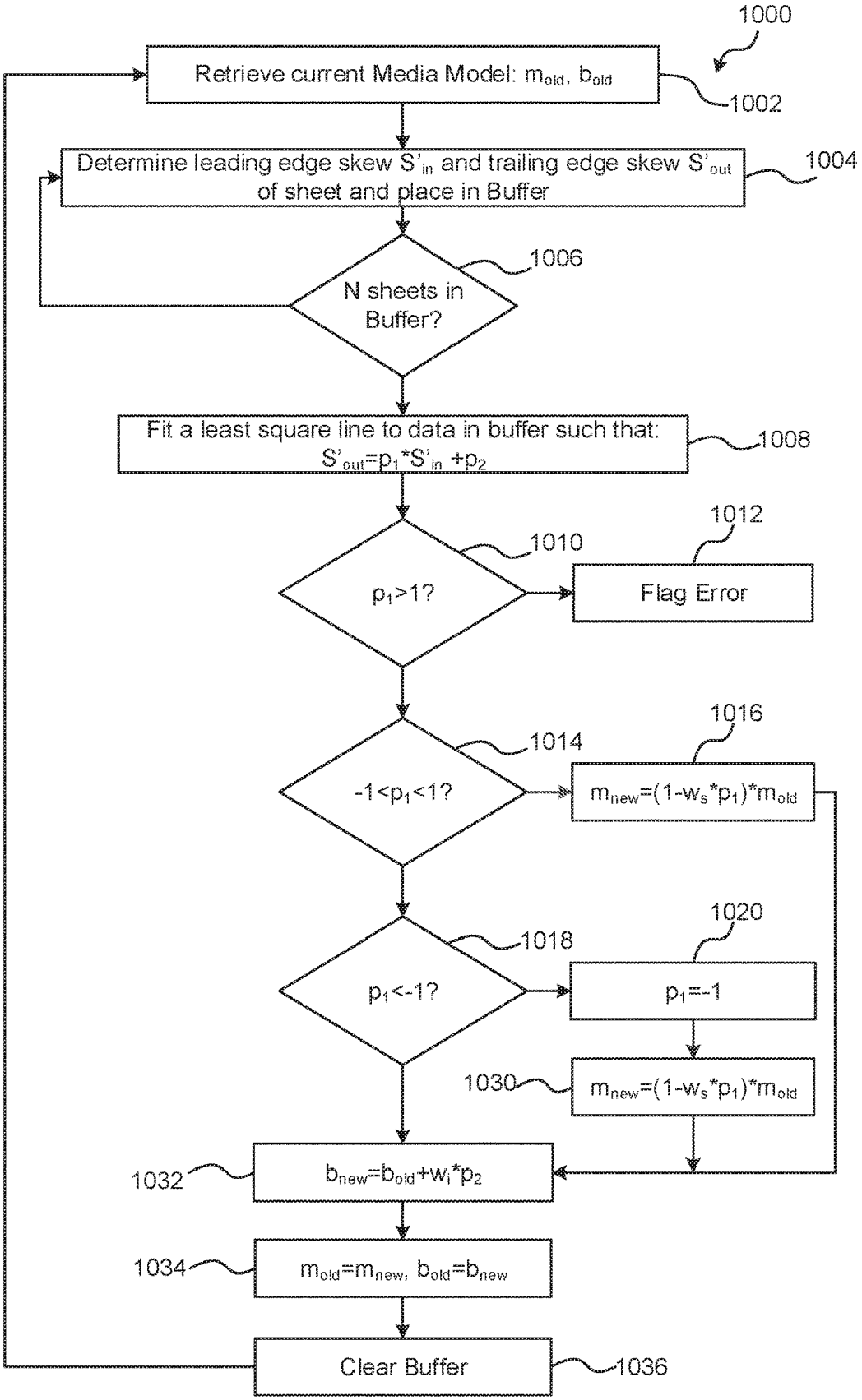
FIG. 10 is a flow chart of an example calibration module for updating a media module.

FIG. 10 is an example flow chart 1000 of the calibration module 192 for updating a media module 150. In block 1002, a media model 150 of '$m_{old}$' and '$b_{old}$' for the media type 107 is retrieved from the memory 130. In block 1004 a leading edge skew 108 $S'_{in}$ and a trailing edge skew $S'_{out}$ of a sheet of media 106 is determined by the pair of media edge sensors 170*a*, 170*b* and placed in buffer 140 in memory 130. In decision block 106, if a predetermined number of sheets N have not had their $S'_{in}$ and $S'_{out}$ placed in the buffer 140, then block 1004 is repeated. Once N sheets $S'_{in}$ and $S'_{out}$ values are placed in the buffer 140, then in block 1008 a least square line is fit to the data in the buffer 140 such that:

$$S'_{out}=p1*S'_{in}+p2$$

Where p1 is the least square fit slope and p2 is the least square fit intercept values determined by:

$$\text{slope } p1 = \frac{\overline{S'_{in}S'_{out}} - \overline{S'_{in}} * \overline{S'_{out}}}{\overline{S'^2_{out}} - (\overline{S'_{in}})^2}$$

$$\text{intercept } p2 = \overline{S'_{out}} - p1 * \overline{S'_{in}}$$

Where $\bar{x}$=mean of x.

Then in decision block 1010, if slope p1 is greater than 1, the skew correction is not working correctly as the trailing edge skew values 109 are larger than the leading edge skew values 108 and thus are being amplified. Accordingly, an error is flagged in block 1012 which may then be used to indicate to the user a need for service or other maintenance.

In decision block 1014 if slope p1 is greater than −1 and less than 1 then the media alignment system 100, 200 is operating correctly and the slope constant in the media model 150 is updated in block 1016 as follows:

$$m_{new}=(1-w_s*p1)*m_{old}$$

Where $w_s$ is a predetermined slope weight value and mow is the current media model 150 slope constant. Adjustment of the intercept constant for the media model 150 continues in block 1032.

In decision block 1018 if slope p1 is less than −1, then the system is overcorrecting and no drastic changes to the media model 150 are wanted. Accordingly, p1 is then set to −1 in block 1020 and the slope constant in the media model 150 is updated in block 1030 as follows:

$$m_{new}=(1+w_s)*m_{old}$$

Where $w_s$ is a predetermined slope weight value and $m_{old}$ is the current media model 150 slope constant. Adjustment of the intercept constant for the media model 150 continues in block 1032.

In block 1032 the intercept constant is updated with the intercept p2 as follows:

$$b_{new}=b_{old}+w_i*p2$$

Where $w_i$ is a predetermined intercept weight value and $b_{old}$ is the current media model 150 intercept constant. Adjustment of the media model 150 continues in block 1034 as follows:

$$m_{old}=m_{new},\ b_{old}=b_{new}$$

Then in block 1036, the buffer 140 is cleared to allow new pairs of leading edge skew values 108 and trailing edge skew values 109 to be collected based off the updated corrected media model 150 and flow continues in block 1002.

Figure 11:
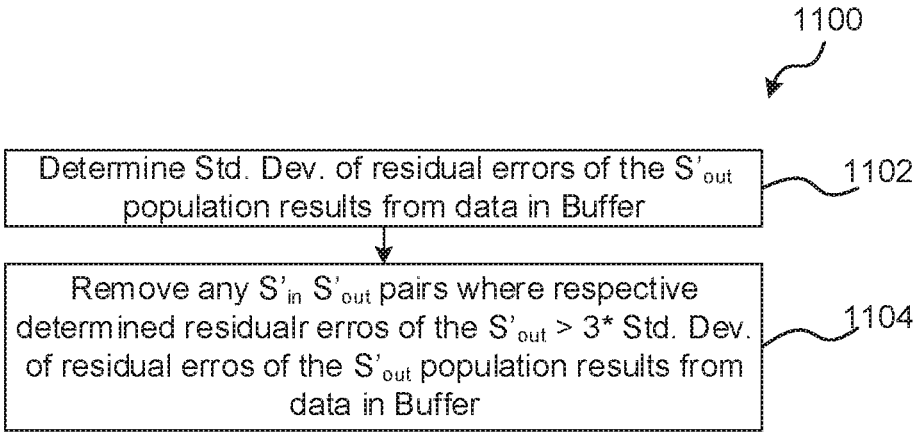
FIG. 11 is an example error reduction flow chart illustrating additional blocks which may be included in the flow chart of FIG. 10 to help reduce or eliminate unwanted stochastic noise.

FIG. 11 is an error reduction flow chart 1100 illustrating additional example blocks which may be included in the flow chart 1000 to help reduce or eliminate unwanted stochastic noise in the auto-tune calibration module 192 iteratively fitting the least square line in block 1008 of FIG. 10. In block 1102, the standard deviation of the residual errors of $S'_{out}$ population results in buffer 140, from the linear regression line as calculated in block 1008 is determined. In block 1104, any $S'_{in}$ and $S'_{out}$ pairs are removed from the data in the buffer 140 if the residual error of respective $S'_{out}$ is greater than three times the standard deviation of the residual errors of $S'_{out}$ population results in the buffer 140 from the linear regression line as calculated in block 1008.

Figure 12:
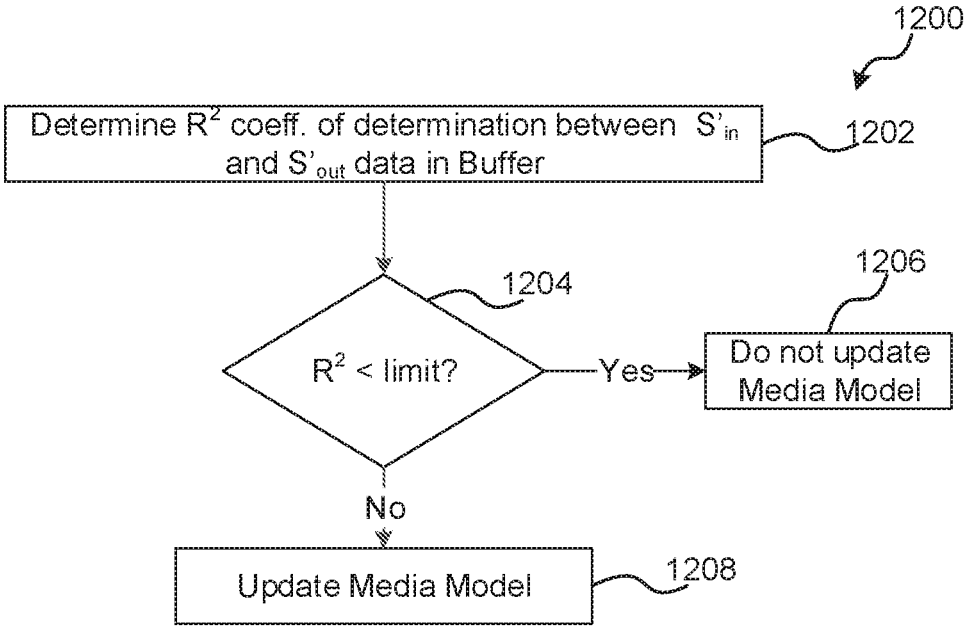
FIG. 12 is an example alternative error reduction flow chart illustrating additional blocks that may be in addition to or in place of the error reduction blocks of FIG. 11.

FIG. 12 is an alternative error reduction flow chart 1200 with example blocks that may be in addition to the error reduction blocks of FIG. 11 or in place of the blocks in FIG. 11. In block 1202 the $R^2$ coefficient of determination between $S'_{in}$ and $S'_{out}$ population data in the buffer 140 is determined as follows:

$$R^2 = \left( \frac{\overline{S'_{in} * S'_{out}} - \overline{S'_{in}} * \overline{S'_{out}}}{\sqrt{\left(\overline{S'^2_{in}} - \overline{S'_{in}}^2\right)\left(\overline{S'^2_{out}} - \overline{S'_{out}}^2\right)}} \right)^2$$

Where $\bar{x}$=mean of x.

In decision block 1204, the determined $R^2$ value is checked against a predetermined limit and if below the limit, then the trailing edge skew values 109 are uncorrelated from the leading edge skew values and in block 1206 the current media model 150 is not updated. This non-update is because the system is either working as expected or is not working as expected without correlation but in either case, no adjustment of the media model is desired. If the determined $R^2$ value is greater or equal to the limit then in block 1208 the media model is allowed to be updated.

The media alignment systems and methods that have been described with auto-tuning calibration allow for a versatile skew correction technique that handles multiple media types and applied media marking coverage conditions to yield excellent uniform performance for high quality media output. It is able to be implemented in firmware with the use of existing hardware having differential drive rollers with little or no additional cost thereby keeping devices affordable. The auto-tune skew correction technique maintains system performance in a wide variety of end user situations. Further, by allowing for increased tolerance limits and less characterization of media alignment systems, money may be saved in manufacturing overhead and product development costs. Accordingly, a wide variety of media may be used with the auto-tune skew correction technique without compromising performance.

While the claimed subject matter has been particularly shown and described with reference to the foregoing examples, those skilled in the art will understand that many variations may be made therein without departing from the spirit and scope of subject matter in the following claims. This description should be understood to include all novel and non-obvious combinations of elements described herein, and claims may be presented in this or a later application to any novel and non-obvious combination of these elements. The foregoing examples are illustrative, and no single feature or element is essential to all possible combinations that may be claimed in this or a later application. Where the claims recite "a" or "a first" element of the equivalent thereof, such claims should be understood to include incorporation of one or more such elements, neither requiring nor excluding two or more such elements.

What is claimed is:

1. A method of calibrating a media alignment system, comprising:

storing, by a controller, a set of paired leading and trailing edge skew values detected using media sensors in a buffer for a media type;

determining, by the controller, a slope relating a trailing edge skew value to its paired leading edge skew value and an intercept representing native skew based on a linear regression of a predetermined number of the set of paired leading and trailing edge skew values, wherein the linear regression produces a response curve that indicates the slope and the intercept; and based on the slope and intercept, updating, by the controller, a media model for the media type based on the linear regression to adjust a differential velocity of a pair of aligned media feed rollers in a media feed mechanism to correct both future native skew and future paired leading and trailing edge skew values in the buffer to within a desired operational window.

2. The method of claim 1, further comprising determining if the trailing edge skew values are inside of the desired operational window and if so, not updating the media model.

3. The method of claim 2, further comprising weighting the slope and the intercept before updating the media model.

4. The method of claim 1, further comprising clearing the buffer and using the updated media model.

5. The method of claim 1, wherein the linear regression ignores paired leading and trailing edge skew values that are outside of a predetermined statistical range of the set of paired leading and trailing edge skew values in the buffer.

6. A media alignment calibration system, comprising:

a media guide mechanism having a first roller and a second roller aligned in a first direction orthogonal to a second direction of media advancement;

a controller to operate independently the first and second rollers;

a memory coupled to the controller;

a pair of media edge sensors coupled to the controller and aligned in the first direction to create a set of paired leading and trailing edge skew values in a buffer in the memory for a media type; and a calibration module in the memory executable by the controller to update a media model of the media type based on a linear regression of the set of values in the buffer to adjust a differential velocity of the first and second rollers to increasingly align a leading edge of a next media within a desired operational window.

7. The system of claim 6, wherein the calibration module is operable at high priority in a background process on the controller.

8. The system of claim 6, wherein the calibration module is operable after a trailing edge skew value is outside of the desired operational window.

9. The system of claim 6, wherein the media model is not adjusted if the linear regression determines the system is operating within a predetermined threshold.

10. The system of claim 6, wherein the media model is not adjusted if an R2 statistic of the linear regression of the set of paired leading and trailing edge skew values in the buffer is below a predetermined limit.

11. A non-transitory computer readable medium comprising instructions for calibrating a media alignment system that when executed by a processor cause the processor to:

determine a slope relating a trailing edge skew value to its paired leading edge skew value and an intercept representing native skew based on a linear regression of a predetermined number of a set of paired leading and trailing edge skew values detected using media sensors for a media type stored in a buffer readable by the processor, wherein the linear regression produces a response curve that indicates the slope and the intercept; and based on the slope and intercept, updating a media model for the media type based on the linear regression to adjust a differential velocity of a pair of aligned media feed rollers in a media feed mechanism to correct both a future native skew and future paired leading and trailing edge skew values in the buffer to within a desired operational window.

12. The computer readable medium of claim 11, further comprising instructions to determine if the trailing edge skew values are inside of the desired operational window and if so, not updating the media model.

13. The computer readable medium of claim 11, further comprising instructions to iteratively update the media model using a weighting of the slope and a weighting of the intercept.

14. The computer readable medium of claim 11, further comprising instructions to calculate an R2 statistic of the linear regression of the set of paired leading and trailing edge skew values in the buffer and not updating the media model when the R2 statistic is below a predetermined value.

15. The computer readable medium of claim 11, further comprising instructions to ignore paired leading and trailing edge skews having a residual error of the paired leading and trailing edge skews that are outside of a predetermined range of the residual error of a population of the set of paired leading and trailing edge skews in the buffer.

* * * * *